United States Patent [19]

Feldkämper

[11] Patent Number: 4,645,339

[45] Date of Patent: Feb. 24, 1987

[54] APPARATUS FOR TESTING THE BASE-FOLDING OF BASES FORMED ON TUBE SECTIONS

[75] Inventor: Richard Feldkämper, Lengerich of Westphalia, Fed. Rep. of Germany

[73] Assignee: Windmoller & Holscher, Lengerich, Fed. Rep. of Germany

[21] Appl. No.: 513,959

[22] Filed: Jul. 15, 1983

Related U.S. Application Data

[63] Continuation-in-part of Ser. No. 208,634, Nov. 20, 1980, abandoned, which is a continuation of Ser. No. 9,174, Feb. 2, 1979, abandoned.

[30] Foreign Application Priority Data

Feb. 8, 1978 [DE] Fed. Rep. of Germany ..... 2805212

[51] Int. Cl.[4] ..... B65H 43/08

[52] U.S. Cl. ..... 356/237; 250/223 R; 250/237 R; 493/12

[58] Field of Search ..... 356/237; 250/223 R, 250/224, 237 R; 209/577, 585, 548; 493/12, 13, 14

[56] References Cited

U.S. PATENT DOCUMENTS

| | | | |
|---|---|---|---|
| 3,365,699 | 1/1968 | Foster | 250/223 R |
| 3,374,714 | 3/1968 | Berghgracht . | |
| 3,524,389 | 8/1970 | Stork . | |
| 3,997,270 | 12/1976 | Suzuki | 250/223 R |

*Primary Examiner*—David C. Nelms
*Assistant Examiner*—Matthew W. Koren
*Attorney, Agent, or Firm*—Fleit, Jacobsen, Cohn & Price

[57] ABSTRACT

In a bag-making macine where a base is formed on an end of a tube section by folding and successively folded tube sections are conveyed transversely at intervals with the main part of each tube section flattened and its folded base perpendicular thereto, photocells are provided to scan the leading and trailing folded edges of each base. The photocells and a light source are disposed on opposite sides of each base and an arcuate disc rotatable about its center of curvature at a circumferential speed equal to the conveying speed of the tube sections bridges the intervals between the bases of successive tube sections so that the photocells remain unexposed unless the bases are deformed.

4 Claims, 2 Drawing Figures

APPARATUS FOR TESTING THE BASE-FOLDING OF BASES FORMED ON TUBE SECTIONS

Figure 1:
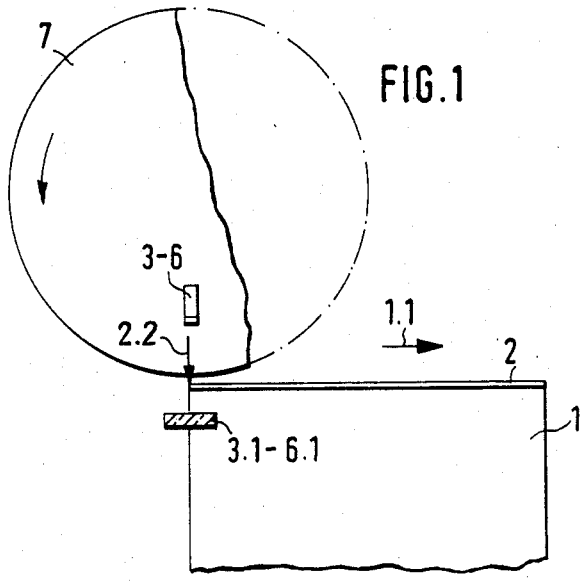

This application is a continuation-in-part of application Ser. No. 208,634, filed Nov. 20, 1980, now abandoned, which is a continuation of application Ser. No. 009,174, filed Feb. 2, 1979, now abandoned.

The invention relates to an apparatus for testing the base folding of bases formed on tube sections in the manufacture of sacks or bags, comprising transporting means conveying the tube sections transversely and photocells scanning the base folding.

In an apparatus of this kind known from DT-PS No. 16 11 647, two groups of photocells are provided which respond to markings or folded edges of the bases, one group testing the leading sides of the bases and the other the trailing sides, and which are activated at the respective instants of testing by photoconductive cells responsive to the leading or trailing edge of the sack, respectively.

In relation to this apparatus of which at least the circuitry is expensive, it is the problem of the invention to provide a simply constructed and readily serviceable apparatus for detecting coarse inaccuracies in the formation of the bases.

According to the invention, this problem is solved in that for controlling the leading and trailing folded edges of the bases which are perpendicular to the flattened tube sections, photocells containing a source of light which eminates from and is directed perpendicular to the bases and are exposed to a reflected light source from the other side of the bases which is reflected off the mirrors back to the light's point of origin within the photocell, and an arcuately curved template is provided which rotates about its centre line of curvature at a circumferential speed corresponding to the transporting speed of the bases, covers the gaps between the successively conveyed bases, and the ends of which overlap the base edges to be tested by an amount corresponding to the desired testing accuracy, the rotary axis of the template being at right-angles to the direction of the test light beam so that the photocells remain dark when the base is correctly formed. The apparatus according to the invention is of simple and clearly arranged construction so that it can be readily serviced even by unskilled personnel. However, it permits the detection of only relatively coarse errors because the overlap of the leading and trailing base edges by the template must be so large that the usual errors in the positioning of the sacks in the machine are not notified as being errors in the construction of the bases. The apparatus of the invention permits the testing of bases that are closed and those that are still open, the contours of the ends of the template being adapted to the shape of the bases to be tested.

For the purpose of controlling the construction of the side edges of the bases, photocells may be disposed at a spacing therefrom corresponding to the desired accuracy of testing, the photocells remaining bright if a base is correctly formed. This is caused by light within the photocell not being obstructed from reflective surface of the mirror which reflects the photocell emitted light back to a receiving portion for the light within the photocell.

If an error is notified, a deflector may be actuated by way of known switching means to eliminate the notified sack.

The particular location of the error may be indicated in that indicators are provided for the respective photocells indicating the error, it being possible to provide relays which can be operated in synchronism with the rotation of the template.

Figure 2:
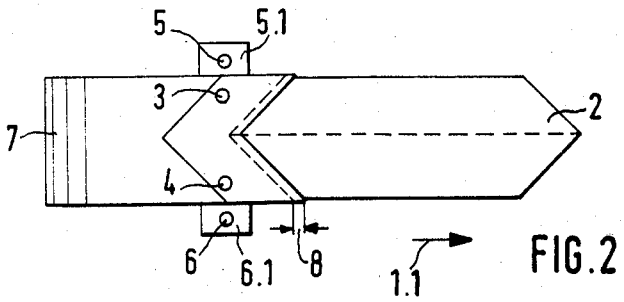

One example of the invention will now be described in more detail with reference to the drawing, wherein:

FIG. 1 is a diagrammatic side elevation of the apparatus for testing the base folding, and FIG. 2 is a plan view of the FIG. 1 apparatus.

A sack 1 is fed horizontally in the direction 1.1 through a base-forming apparatus (not shown). A base 2 of the sack 1 is, for example, to be tested to check that it has been correctly folded shut. Photocells 3 to 6 with mirrors 3.1 to 6.1 are directed onto the plane defined by the base 2. The photocells 3 to 6 produce a light which is directed in the direction of, and along the path of arrow 2.2. The mirrors 3.1 to 6.1 reflect the light from the photocells, if they are not obstructed, in a direction opposite to that of arrow 2.2. Light receiving portions within the photocells 3 to 6, receive the reflected light from the mirrors 3.1 to 6.1. The light produced within the photocell is aligned such that reflection from the mirrors will be directed towards the light receiving portion of the photocells. The photocells are of a conventional type, such as where the light source and the light receiving portion are side by side, positioned such that when the light is reflected from a mirror, the light is reflected to the light receiving portion or of the type wherein the light source is located behind the light receiving portion such that a smaller diameter light receiving portion partially blocks the larger diameter beam of light which is reflected into the light receiving portion by way of a mirror. A template 7 rotating in synchronism with the speed at which the sack 1 is advanced through the base-forming apparatus is constructed so that the free space remaining between the bases is covered and the photocells 3 and 4 notify a dark signal. The photocells 5, 6 stay bright permanently and only switch to dark if parts of the base 1 project, i.e. if it is not correctly formed.

As is illustrated, the template 7 has the shape of the base 1 to be tested and overlaps the base 2 by a distance 8. The distance 8 corresponds to the error that may occur when the sack 1 is engaged by the grippers of the base-forming apparatus. If there are gaps between the template 7 and base 2 by reason of wrong formation of the base 2, the corresponding photocells 3 or 4 or both switch over to bright.

Their error signal can be processed for display purposes or to actuate an eliminating deflector. The errors at the start or end of the base can be separately displayed by relays which operate in rhythm with the rotation of the template 7. The dark signal of the photocells 5, 6 can likewise be processed for display purposes or to actuate an eliminating deflector.

I claim:

1. Apparatus for testing the base folding of bases formed on tube sections in the manufacture of sacks or bags, said apparatus comprising:

transporting means for conveying the tube sections, photocells scanning the base folding for dectecting inaccuracies in leading and trailing folded edges of the bases which are aligned perpendicular to the flattened tube sections, said photocells being directed perpendicular to the bases and being exposed to a light source projected from one side of the bases, and an arcuately curved template provided which rotates about its centre line of curvature at a circumferential speed corresponding to the transporting speed of the bases, said template covering the gaps between the successively conveyed bases, and the ends of said template overlap the base edges to be tested by an amount corresponding to a desired testing accuracy, a rotary axis of the template being at right-angles to the direction of a test light beam so that the photocells remain dark when the base is correctly formed.

2. Apparatus according to claim 1, characterised in that to control the formation of the side edges of the bases, the photocells are disposed at a spacing therefrom corresponding to the desired testing accuracy and remain bright when the base is correctly formed.

3. Apparatus for testing the base folding of bases formed on tube sections in the manufacture of sacks, properly formed sacks being transversely conveyed through the apparatus with a predetermined spacing therebetween, said apparatus comprising:

a photocell disposed on one side of a conveying plane of the sacks;

light source means for producing a test light beam passing through the conveying plane of the sacks for illuminating said photocell, the light source means being positioned so that a base of a properly formed sack passing through said apparatus prevents illumination of said photocell by said test light beam; and means for preventing passage of said test light beam through a gap between bases of properly formed sacks passing through said apparatus including a rotatable member having a portion thereof forming an arcuately curved template, the shape of the template being such that the template covers the gap between adjacent properly formed sacks, the member being rotatable about an axis at a speed such that the circumferential speed of the template corresponds to the transporting speed of the sacks whereby the template cooperates with bases of properly formed sacks to prevent illumination of said photocell by said light source means.

4. An apparatus according to claim 3, further comprising a second photocell laterally spaced from the photocell disposed on the one side of the conveying plane of the sacks, said light source means producing a test light beam for illuminating said second photocell, the relationship between said light source means and said second photocell being such that illumination of said second photocell by said light source means is prevented by cooperation between bases of properly formed sacks and said template.

* * * * *